US006431286B1

(12) United States Patent
Andreychuk

(10) Patent No.: US 6,431,286 B1
(45) Date of Patent: Aug. 13, 2002

(54) PIVOTING INJECTOR ARRANGEMENT

(75) Inventor: Mark T. Andreychuk, Cochrane (CA)

(73) Assignee: Cancoil Integrated Services Inc., Calgary (CA)

( * ) Notice: Subject to any disclaimer, the term of this patent is extended or adjusted under 35 U.S.C. 154(b) by 0 days.

(21) Appl. No.: 09/685,593

(22) Filed: Oct. 11, 2000

(51) Int. Cl.[7] ..... E21B 19/00; E21B 19/22
(52) U.S. Cl. ..... 166/384; 166/75.14; 166/77.2
(58) Field of Search ..... 166/75.11, 75.14, 166/77.1, 77.2, 77.4, 381, 384

(56) References Cited

U.S. PATENT DOCUMENTS 3,042,377 A * 7/1962 Woolslayer et al. ..... 254/400
4,336,840 A * 6/1982 Bailey ..... 16/77.4
5,839,514 A * 11/1998 Gipson ..... 166/384
5,992,516 A * 11/1999 Palynchuk et al. ..... 166/772
6,003,598 A 12/1999 Andreychuk
6,032,744 A * 3/2000 Burge et al. ..... 166/385
6,273,188 B1 * 8/2001 McCafferty et al. ..... 166/77.2

* cited by examiner

*Primary Examiner*—David Bagnell
*Assistant Examiner*—Jennifer H Gay
(74) *Attorney, Agent, or Firm*—Thomas E. Malyszko

(57) ABSTRACT

An injector arrangement for use in a rig has a movable carrier, a derrick tiltably mounted to the carrier, and a trolley capable of sliding along the derrick. An injector cradle is movable along the trolley in at least a plane perpendicular to the derrick and is pivotally mounted beneath the trolley. An injector is supported at its upper end from the cradle. At least two hydraulic cylinders are supported at one end by the derrick and are engaged at an opposed end to a lower end of the injector for rotating and tilting the injector relative to the trolley and derrick.

57 Claims, 1 Drawing Sheet

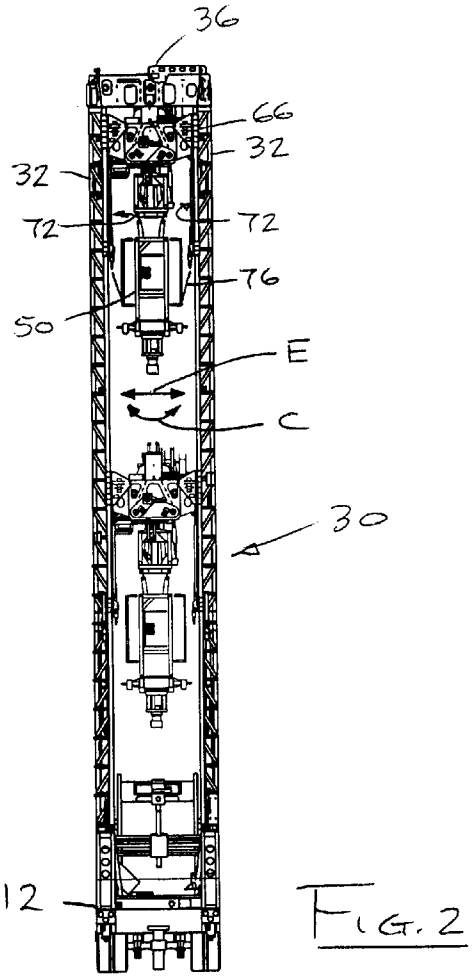
FIG. 2
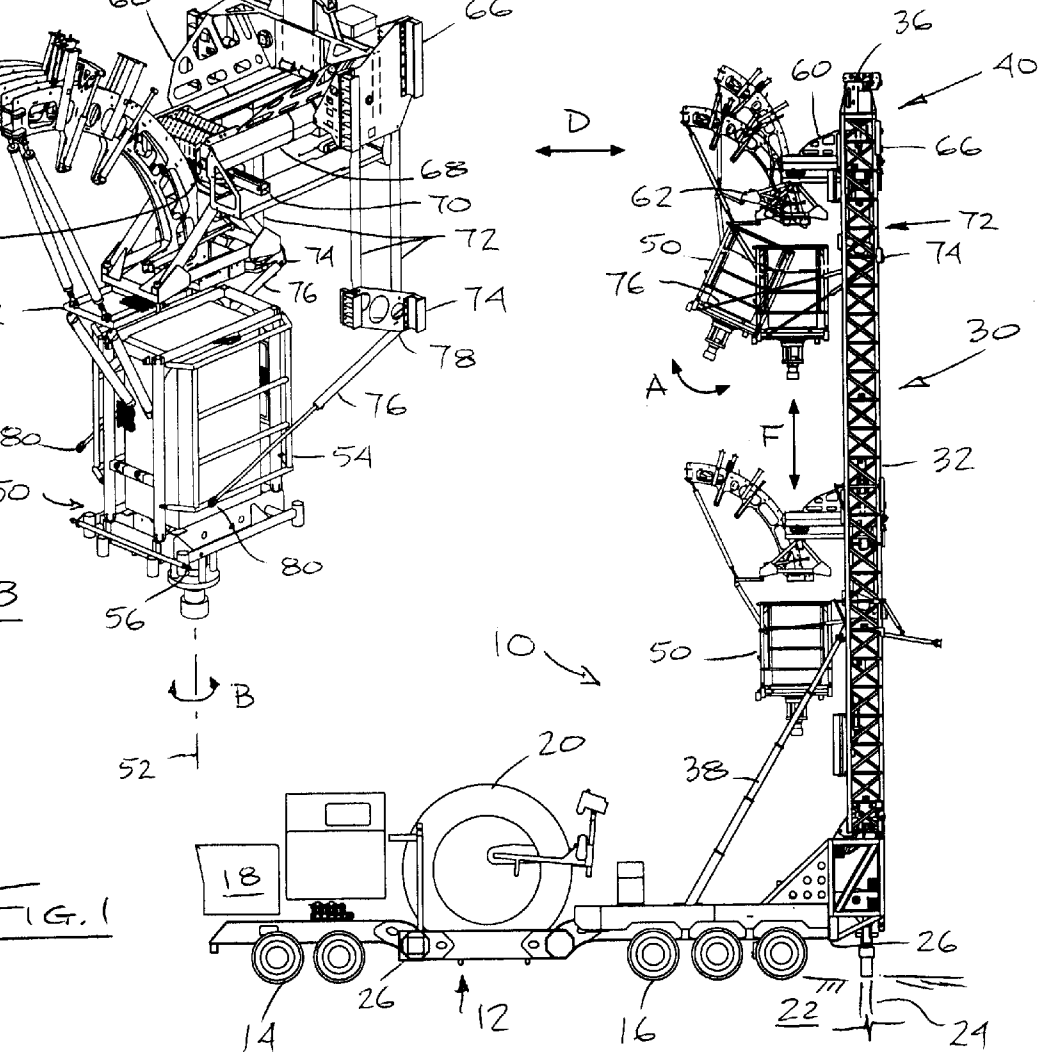
FIG. 1
FIG. 3

PIVOTING INJECTOR ARRANGEMENT

FIELD OF THE INVENTION

The present invention relates to drilling and servicing equipment for oil and gas wells generally, and in particular relates to an arrangement for multi-dimensional pivoting of an injector for use in rigs which transport and/or operate equipment for continuous coiled tubing drilling, for conventional joined pipe handling and drilling, and/or for wireline applications.

BACKGROUND OF THE INVENTION

Applicant's U.S. Pat. No. 6,003,598 and corresponding Canadian Patent 2,235,555 for a "Mobile Multi-Function Rig" disclose an injector carried by a cradle which is movable in two planes, namely in both generally vertical and horizontal planes, when the derrick is in an upright operating mode. Such movement helps align an injector over a wellhead. Should the wellbore be inclined, such as in a "slant well", then the orientation of the injector must be further adjusted by slanting the derrick accordingly in one vertical plane and, if need be, the rig's chassis stabilizers can be manipulated somewhat to provide tilt in a second vertical plane. In an exceptional case where the range of adjustment of the rig's equipment is insufficient for proper alignment, the rig itself may have to be moved and parked again in a different approach to the well. Although such manipulation provides an advantageous three dimensional ("3-D") maneuvering capability to the injector, the procedure is somewhat cumbersome and time consuming.

Other conventional derricks, particularly those used on mobile carriers, are more restricted in their ability to line up with and service slant wells. What is desired therefore is a novel injector cradle or trolley arrangement for use in rigs, particularly multi-task rigs which transport and/or operate equipment for oil and gas operations. The arrangement should allow accurate alignment of the injector with a well, such as a slant well, to reduce or avoid the need to either tilt the mast or move the carrier to achieve a desired alignment with the well. In particular, the novel arrangement should allow the injector to be moved laterally in two directions relative to the derrick, generally vertically along the derrick, and to tilt and rotate relative to the derrick, so as have up to 6 degrees of freedom relative to the well, exclusive of any inclining of the derrick or movement of the rig itself.

SUMMARY OF THE PRESENT INVENTION

According to the present invention, there is provided in one aspect an injector arrangement for use in a rig comprising a mobile carrier, a derrick pivotally mounted to the carrier, a trolley capable of sliding along the derrick, an injector cradle movable along the trolley in at least a plane perpendicular to the derrick and having an upper end pivotally mounted beneath the trolley, an injector supported by the injector cradle, and at least two hydraulic cylinders supported at one end by the derrick and engaged at an opposed end to a lower end of the injector for rotating and tilting the injector relative to the trolley and derrick.

BRIEF DESCRIPTION OF THE DRAWING FIGURES

Embodiments of the invention will now be described, by way of example only, with reference to the accompanying drawings, wherein:

FIG. 1 is a side view of a mobile multi-function rig which employs a trolley and cradle for supporting and manipulating an injector according to a preferred embodiment of the present invention showing two selected vertical locations of the injector when moved laterally out of the plane of the rig's derrick, and one view of the injector in a tilted position;

FIG. 2 is an end view of the derrick of FIG. 1; and,

FIG. 3 is a close-up perspective view of the trolley, cradle and injector arrangement of the present invention.

LIST OF REFERENCE NUMBERS IN DRAWINGS

10 mobile rig
12 carrier
14 front end of 12
16 rear end of 12
18 cab
20 cartridge assembly
22 ground surface
24 well
26 stabilizers
30 derrick
32 masts (2)
36 crown
38 hydraulic legs
40 winch assembly
50 injector
52 axis
54 cage of 50
56 point on injector
60 trolley
62 cradle
63 ball connection of 62 to 60
64 chimney of 60
66 c-shaped channel
68 tracks (first)
70 second track
72 brace arms
74 guide member
76 tilt cylinder(s)
78 first end of 76
80 second end of 76

DESCRIPTION OF PREFERRED EMBODIMENTS

FIG. 1 shows a mobile rig 10 for transporting drilling and servicing equipment to an oil or gas well site. The equipment, such as a cartridge assembly 20 capable of holding various sizes of continuous or coiled tubing ("CT") reels, is located aboard a self-propelled carrier 12 having a tandem axle front end 14 and a triple axle rear end 16. A cab 18 houses an engine for driving the front and/or rear axles, and incorporates conventional controls for steering the carrier over a ground surface 22 and for locating the carrier's rear end over a well. The term "well" is understood herein to mean either an oil or gas well to be drilled, or an existing well or wellhead 24 which is to be tested or serviced. The carrier 12 incorporates a number of hydraulically operated stabilizers 26 for lifting the carrier off the ground and enhancing lateral stability during well operations. The front and rear axle designs may vary depending on the anticipated weight of equipment to be carried and the type of terrain to be encountered. The carrier's design is generally symmetrical about its longitudinal axis.

The rig 10 includes a number of drilling and servicing features aboard the mobile carrier 12, including a derrick 30 pivotally mounted to the rear of the carrier. The derrick is capable of supporting a blow out preventer ("BOP") and an injector 50 for moving CT into and out of the well. The derrick incorporates a winch arrangement 40 to perform multiple tasks, such as raising and lowering the injector and a lubricator along the derrick, as well as running joined pipe segments. The derrick 30 has two longitudinally spaced mast members 32 (see FIG. 2), each formed by a triangular (in cross-section) truss arrangement. A telescoping hydraulic cylinder or leg 38 is attached to each mast to tilt the derrick 30 between a transportation mode and an operating mode, as set out in more detail in applicant's U.S. Pat. No. 6,003,598. The masts 32 are joined at the top end by a crown 36 housing a pair of conventional pulley wheels, or "sheaves", which carry steel cables and a traveling block of the winch assembly. The traveling block fits from below into a chimney element 64 extending upwardly from the injector's trolley 60 (FIG. 3) so that the winch assembly can slide the trolley and injector generally vertically along the elevated masts 32 to any desired location, two of which are shown in FIGS. 1&2. The traveling block may also be used independently of the injector for performing other tasks, such as moving joined pipe sections, by first locking the injector trolley 60 at the top of the derrick and parking the injector out of the plane of the derrick, as seen in FIG. 1.

Referring now more specifically to FIG. 3, a pair of c-shaped channel members 66, one on either side of the generally symmetrical trolley 60, engage and ride on the masts 32 as the trolley is lifted or lowered by the earlier described winch mechanism. The trolley has a first set of tracks 68 for moving the cradle 62, which supports the injector 50 from above, laterally out of the plane of the derrick via a screw mechanism. In the embodiment shown, the tracks 68 provide up to 54 inches (about 1372 mm) of lateral movement, and the trolley is capable of traveling along the derrick whether the injector is located within the derrick or is "parked" laterally out of the plane of the derrick. A second track 70 located beneath and perpendicular to the first set of tracks 68 allows the cradle to move generally horizontally and parallel to the plane of the derrick via a side-to-side cylinder. In the embodiment shown, the cradle may be moved up to 6 inches (about 152 mm) to either side of centre.

An upper portion of the cradle 62 is supported beneath the trolley 60 via a ball-like connection 63 to allow the cradle and injector to be pivoted relative to the trolley and derrick by a novel injector pivoting arrangement of the present invention. A brace, namely a pair of brace arms 72, extends downwardly from each channel 66 to a c-shaped guide member 74 which is located in-line with the channel 66 to ride along a respective mast 32. A hydraulic tilt cylinder or ram 76 is connected at a first end 78 to the guide member 74 and at an opposed second end 80 to the injector 50. In the preferred embodiment the cylinder's second end 80 is connected to a lower portion of a protective cage 54 of the injector 50, at a point generally furthest from the derrick for easier tilting and rotating of the injector (i.e. cantilever effect). Another acceptable location may be at a point 56 on a lower platform of the injector. Each cylinder 76 is capable of being controlled independently of the other.

Some of the movement made available by the present arrangement should now be better understood. If both tilt cylinders 76 are extended or retracted a like amount, the injector is tilted relative to the trolley away or toward the derrick as indicated by arrow A in FIG. 1. If one cylinder 76 is extended and the other retracted a like amount, then the injector is rotated a limited amount about an axis 52 as indicated by arrow B (FIG. 3). If one cylinder is not activated and the other is either retracted or extended, then a combination of movements A and B results in a pivoting-like motion generally indicated by arrow C (FIG. 2). In addition, the cradle 62 is capable of moving the injector in and out of the derrick, and side-to-side relative to the derrick, as indicated by arrows D and E, respectively. As noted earlier, the trolley 60 supporting the cradle is movable along the derrick as indicated by arrow F. Hence, the injector 50 has up to 6 degrees of freedom, or movement, relative to a wellhead for proper alignment, excluding the tiltability of the derrick with the legs 38 and the movement of the carrier 12 itself relative to the well.

An example of a typical rig operation may now be outlined for aligning the injector with a well, with the aid of the preferred embodiment of the pivoting injector arrangement of the present invention. The rear end of the carrier 12 is first backed up over the well, and the derrick is inclined roughly parallel to the well via legs 38. The trolley 60 is brought (i.e. is elevated or lowered in the direction of arrow F) to a desired height along the derrick. Once these preliminary or "rough" alignments are completed, then "finer" adjustments of the injector 50 are made by moving the injector cradle 62 along the track 70 (in the direction of arrow E) and, if necessary, along the tracks 68 (in the direction of arrow D) to bring the injector into closer alignment with the well. If need be, even finer adjustments may then be made of the injector orientation by manipulating the tilt cylinders 76 to move the injector in one or more of directions A, B and C. The desired orientation of the injector with the well should therefore be achieved. It will be appreciated that once the carrier is parked and the derrick is properly elevated, then the injector is aligned in any one or more of the movements A, B, C, D and E, in no particular order.

Among other advantages, the present invention eliminates the need to move major components of the rig, such as the derrick, to achieve fine adjustments of the injector relative to the well. Very small, precise movements of the derrick, and to a lesser extent of the trolley, are cumbersome and somewhat difficult or sometimes impossible to make. The present invention allows a rig operator to make crude adjustments with these larger components, then to make more precise adjustments using the cradle, and finally to easily and quickly make the fine adjustments for proper alignment with the tilt cylinders 76. This should provide considerable savings in time (and hence money) for properly aligning the injector. Proper alignment will further reduce stress and undue wear on well servicing equipment.

The above description is intended in an illustrative rather than a restrictive sense, and variations to the specific configurations described may be apparent to skilled persons in adapting the present invention to other specific applications. Such variations are intended to form part of the present invention insofar as they are within the spirit and scope of the claims below. For instance, it may be possible to use more that two tilt cylinders to manipulate the injector, although this is not preferred due to increased equipment requirements and control complexities.

I claim:

1. An injector arrangement for use on a derrick comprising:

a trolley mountable to said derrick for movement therealong;

a cradle pivotally mounted to said trolley;

an injector supported from said cradle; and, hydraulic means operatively engaged to said trolley and to said injector for providing said injector with at least three degrees of movement relative to said cradle.

2. The injector arrangement of claim 1 wherein in one aspect of said at least three degrees of movement said hydraulic means is adapted to tilt said injector about a generally horizontal axis substantially parallel to the plane of the derrick.

3. The injector arrangement of claim 2 wherein in another aspect of said at least three degrees of movement said hydraulic means is adapted to rotate said injector about an axis passing through said injector.

4. The injector arrangement of claim 3 wherein in yet another aspect of said at least three degrees of movement said hydraulic means is adapted to pivot said injector about an axis substantially perpendicular to the plane of the derrick.

5. The injector arrangement of claim 2 wherein in another aspect of said at least three degrees of movement said hydraulic means is adapted to pivot said injector about an axis substantially perpendicular to the plane of the derrick.

6. The injector arrangement of claim 2 wherein said trolley further includes a track assembly to provide said injector with at least two additional degrees of movement relative to said trolley.

7. The injector arrangement of claim 1 wherein in one aspect of said at least three degrees of movement said hydraulic means is adapted to rotate said injector about an axis passing through said injector.

8. The injector arrangement of claim 7 wherein in another aspect of said at least three degrees of movement said hydraulic means is adapted to pivot said injector about an axis substantially perpendicular to the plane of the derrick.

9. The injector arrangement of claim 7 wherein said trolley further includes a track assembly to provide said injector with at least two additional degrees of movement relative to said trolley.

10. The injector arrangement of claim 1 wherein in one aspect of said at least three degrees of movement said hydraulic means is adapted to pivot said injector about an axis substantially perpendicular to the plane of the derrick.

11. The injector arrangement of claim 10 wherein said trolley further includes a track assembly to provide said injector with at least two additional degrees of movement relative to said trolley.

12. The injector arrangement of claim 1 wherein said trolley further includes a track assembly to provide said injector with at least two additional degrees of movement relative to said trolley.

13. The injector arrangement of claim 12 wherein in one aspect of said at least two additional degrees of movement said track assembly is adapted to move said cradle in and out of said derrick along an axis substantially perpendicular to the plane of said derrick.

14. The injector arrangement of claim 13 wherein in another aspect of said at least two additional degrees of movement said track assembly is adapted to move said cradle side-to-side relative to said derrick along an axis substantially parallel to the plane of said derrick.

15. The injector arrangement of claim 12 wherein in one aspect of said at least two additional degrees of movement said track assembly is adapted to move said cradle side-to-side relative to said derrick along an axis substantially parallel to the plane of said derrick.

16. The injector arrangement of claim 1 wherein said hydraulic means comprises at least two movable arms supported at one end by said trolley and engaged at an opposed end with said injector.

17. The injector arrangement of claim 16 wherein said injector is located beneath said cradle and said arms comprise hydraulic cylinders.

18. A derrick for use in well drilling or servicing operations having a trolley movably mounted thereon comprising:

a cradle pivotally engaged with said trolley;

an injector mounted to said cradle; and, a ram assembly operatively engaged with said trolley and with said injector for providing said injector with at least three degrees of movement.

19. The derrick of claim 18 wherein said ram assembly comprises at least two movable arms operatively engaged at one end to said trolley and at an opposed second end to said injector.

20. The derrick of claim 19 wherein one aspect of said at least three degrees of movement comprises tilting said injector about a generally horizontal axis extending substantially parallel to said derrick by retracting or extending each of said at least two arms a like amount.

21. The derrick of claim 20 wherein another aspect of said at least three degrees of movement comprises rotating said injector about a generally vertical axis passing through said injector by retracting one of said at least two arms and extending another of said at least two arms a like amount.

22. The derrick of claim 21 wherein another aspect of said at least three degrees of movement comprises pivoting said injector about a generally horizontal axis extending substantially perpendicular to said derrick by differentially extending or retracting said at least two arms.

23. The derrick of claim 22 further comprising a track means for moving said cradle relative to said trolley to provide said injector with at least two additional degrees of movement.

24. The derrick of claim 23 wherein said track means includes a first track assembly on said trolley for moving said cradle generally perpendicularly to said derrick.

25. The derrick of claim 24 wherein said track means further includes a second track assembly on said trolley for moving said cradle generally perpendicularly to said first track assembly.

26. The derrick of claim 20 wherein another aspect of said at least three degrees of movement comprises pivoting said injector about a generally horizontal axis extending substantially perpendicular to said derrick by differentially extending or retracting said at least two arms.

27. The derrick of claim 20 further comprising a track means for moving said cradle relative to said trolley to provide said injector with at least two additional degrees of movement.

28. The derrick of claim 19 wherein one aspect of said at least three degrees of movement comprises rotating said injector about a generally vertical axis passing through said injector by retracting one of said at least two arms and extending another of said at least two arms a like amount.

29. The derrick of claim 28 wherein yet another aspect of said at least three degrees of movement comprises pivoting said injector about a generally horizontal axis extending substantially perpendicular to said derrick by differentially extending or retracting said at least two arms.

30. The derrick of claim 28 further comprising a track means for moving said cradle relative to said trolley to provide said injector with at least two additional degrees of movement.

31. The derrick of claim 19 wherein one aspect of said at least three degrees of movement comprises pivoting said injector about a generally horizontal axis extending substantially perpendicular to said derrick by differentially extending or retracting said at least two arms.

32. The derrick of claim 31 further comprising a track means for moving said cradle relative to said trolley to provide said injector with at least two additional degrees of movement.

33. The derrick of claim 19 further comprising a track means for moving said cradle relative to said trolley to provide said injector with at least two additional degrees of movement.

34. The derrick of claim 18 further comprising a track means for moving said cradle relative to said trolley to provide said injector with at least two additional degrees of movement.

35. The derrick of claim 34 wherein said track means includes a first track assembly on said trolley for moving said cradle generally perpendicularly to said derrick.

36. The derrick of claim 35 wherein said track means further includes a second track assembly on said trolley for moving said cradle generally perpendicularly to said first track assembly.

37. The derrick of claim 34 wherein said track means includes a second track assembly on said trolley for moving said cradle generally perpendicularly to said first track assembly.

38. A method of moving an injector arrangement on a derrick having a trolley movably mounted thereon, a cradle pivotally mounted to said trolley and an injector supported from said cradle, said method comprising moving said injector in at least three degrees of freedom relative to said cradle using hydraulic means operatively engaged to said trolley and said injector.

39. The method of claim 38 wherein one aspect of said at least three degrees of freedom comprises tilting said injector about an axis which is substantially parallel to the plane of the derrick.

40. The method of claim 39 wherein another aspect of said at least three degrees of freedom comprises rotating said injector about an axis passing through said injector.

41. The method of claim 40 wherein yet another aspect of said at least three degrees of freedom comprises pivoting said injector about an axis which is substantially perpendicular to the plane of the derrick.

42. The method of claim 41 further comprising moving said cradle relative to said trolley to provide said injector with at least two additional degrees of freedom.

43. The method of claim 39 wherein another aspect of said at least three degrees of freedom comprises pivoting said injector about an axis which is substantially perpendicular to the plane of the derrick.

44. The method of claim 39 further comprising moving said cradle relative to said trolley to provide said injector with at least two additional degrees of freedom.

45. The method of claim 38 wherein one aspect of said at least three degrees of freedom comprises rotating said injector about an axis passing through said injector.

46. The method of claim 45 wherein another aspect of said at least three degrees of freedom comprises pivoting said injector about an axis which is substantially perpendicular to the plane of the derrick.

47. The method of claim 45 further comprising moving said cradle relative to said trolley to provide said injector with at least two additional degrees of freedom.

48. The method of claim 38 wherein one aspect of said at least three degrees of freedom comprises pivoting said injector about an axis which is substantially perpendicular to the plane of the derrick.

49. The method of claim 48 further comprising moving said cradle relative to said trolley to provide said injector with at least two additional degrees of freedom.

50. The method of claim 38 further comprising moving said cradle relative to said trolley to provide said injector with at least two additional degrees of freedom.

51. The method of claim 50 wherein one aspect of said at least two additional degrees of movement comprises moving said cradle in and out of said derrick along an axis substantially perpendicular to the plane of said derrick.

52. The method of claim 51 wherein another aspect of said at least two additional degrees of movement comprises moving said cradle side-to-side relative to said derrick along an axis substantially parallel to the plane of said derrick.

53. The method of claim 50 wherein one aspect of said at least two additional degrees of movement comprises moving said cradle side-to-side relative to said derrick along an axis substantially parallel to the plane of said derrick.

54. A rig for drilling and servicing a well comprising:

a mobile carrier;

a derrick pivotally mounted to the carrier;

a trolley capable of sliding along the derrick;

a cradle movable along the trolley in at least a plane perpendicular to the derrick and pivotally mounted beneath the trolley;

an injector having an upper portion supported from the cradle and an opposed lower portion; and, at least two extendable arm members supported at one end by the trolley and engaged at an opposed end to the injector for rotating and tilting the injector relative to the trolley and derrick about at least two axes.

55. The rig of claim 54 wherein said arm members comprise hydraulic cylinders having said opposed ends engaged to the lower portion of the injector.

56. The rig of claim 55 wherein said trolley includes a track assembly comprising a first track for moving the cradle in a first direction along the trolley.

57. The rig of claim 56 wherein said track assembly further includes a second track for moving the cradle generally perpendicularly to the first track.

* * * * *